United States Patent [19]

Alexander et al.

[11] Patent Number: 4,919,377

[45] Date of Patent: Apr. 24, 1990

[54] SHEET DISPENSER AND DISPLAY AND HOLDER THEREFOR

[75] Inventors: Herman P. Alexander, Merrick; John D. Langwell, Freeport, both of N.Y.

[73] Assignee: Sandy Alexander, Inc., Clifton, N.J.

[21] Appl. No.: 149,334

[22] Filed: Jan. 28, 1988

[51] Int. Cl.[5] ..... A47B 96/06

[52] U.S. Cl. ..... 248/225.1; 40/124.1; 40/651; 211/57.1

[58] Field of Search ..... 248/225.1, 221.4, 222.3, 248/459; 40/650, 651, 658, 124.1; 211/57.1

[56] References Cited

U.S. PATENT DOCUMENTS

| | | | |
|---|---|---|---|
| 2,506,461 | 5/1950 | Leach | 248/459 X |
| 2,530,950 | 11/1950 | Ebert et al. | 248/459 X |
| 2,720,044 | 4/1952 | Montalto | 40/16 |
| 2,755,576 | 12/1950 | Golden | 40/10 |
| 2,770,411 | 11/1956 | MacKay | 229/43 |
| 3,290,809 | 4/1966 | King | 40/10 |
| 3,711,977 | 1/1973 | Blankenhorn | 40/124.1 |
| 3,753,305 | 8/1973 | Mueh | 40/125 |
| 3,758,065 | 9/1973 | Ranseen | 248/459 |
| 3,824,720 | 7/1974 | Langwell | 40/10 |
| 3,881,649 | 5/1975 | Krautsack | 229/38 |
| 3,899,841 | 8/1975 | Berger | 40/658 |
| 3,945,559 | 3/1976 | Krautsack | 229/38 |
| 3,977,109 | 8/1976 | Berry, Jr. et al. | 40/124.1 |
| 4,016,977 | 4/1977 | Krautsack | 206/526 |
| 4,113,109 | 9/1978 | Donnelli et al. | 211/49 |
| 4,152,851 | 5/1979 | Goldstein | 40/10 |
| 4,179,138 | 12/1979 | Bogdanovic | 248/221.4 X |
| 4,477,048 | 10/1984 | Conway | 248/447.1 |
| 4,541,598 | 9/1985 | Villanueva et al. | 248/221.4 |
| 4,572,380 | 2/1986 | Langwell | 211/57.1 |
| 4,693,441 | 9/1987 | Conway | 211/57.1 X |
| 4,716,669 | 1/1988 | Fast | 40/650 |
| 4,718,627 | 1/1988 | Fast et al. | 248/225.1 |
| 4,798,014 | 1/1989 | Stoerzinger et al. | 40/124.1 |

*Primary Examiner*—David L. Talbott
*Attorney, Agent, or Firm*—Blum Kaplan

[57] ABSTRACT

A sheet dispenser and display is provided which includes a holder adapted to support a pad and a display car behind the pad, the holder being mountable on a support such as a price channel. The holder may be formed of a flat sheet of flexible material adapted for coupling to the price channel. A pair of spaced flexible prongs project from the mounting portion for receipt in apertures in the pad. A card support portion is coupled by a pair of laterally spaced legs to the mounting portion intermediate the prongs for supporting the display card. The display card may be provided with a portion which extends in a direction substantially perpendicular to the support for projecting into a store aisle.

22 Claims, 3 Drawing Sheets

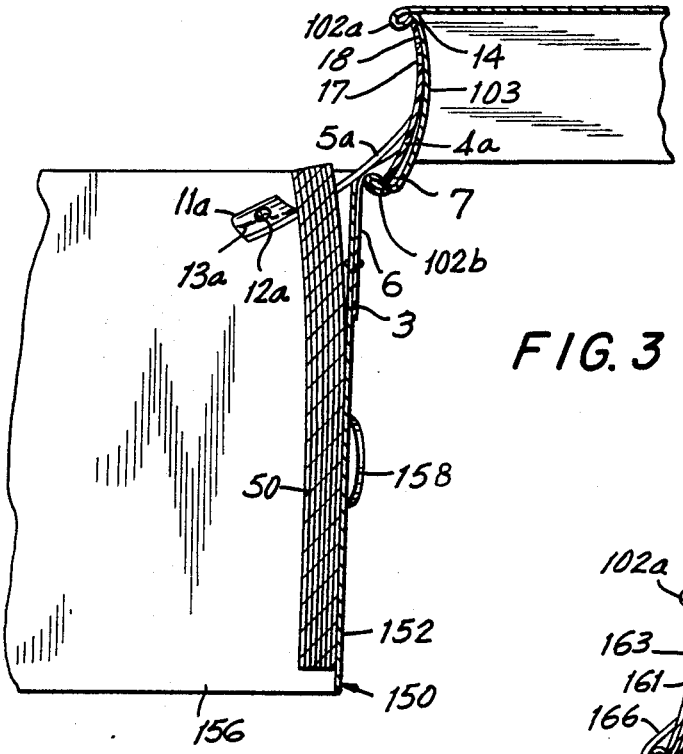
FIG. 3
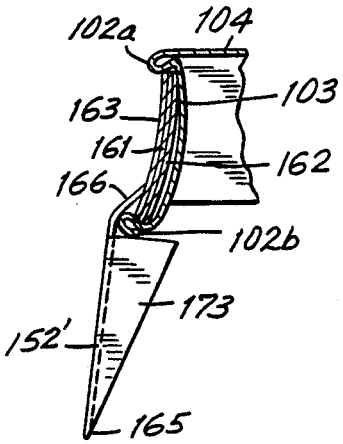
FIG. 7
FIG. 4
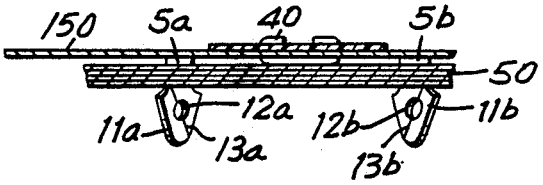
FIG. 6
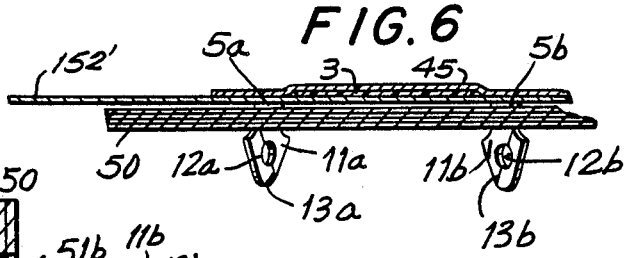
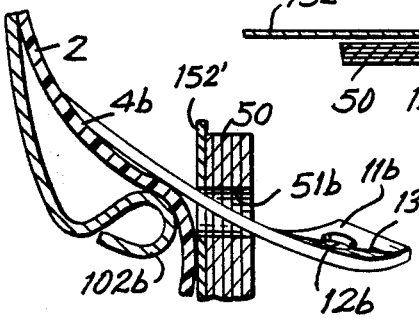
FIG. 8

SHEET DISPENSER AND DISPLAY AND HOLDER THEREFOR

BACKGROUND OF THE INVENTION

This invention relates to a holder for a promotional display which can include both a sign or display card extending perpendicular to a display shelf and a pad of sheets adapted for removal, one sheet at a time, and to the display assembly. Such a display assembly will generally be used for point-of-purchase advertising to attract the attention of potential customers, as a dispenser for discount coupons, or the like.

It has become common to place promotional material such as recipes; rebate tickets, discount coupons, advertising flyers and the like in supermarkets, drug stores, and various other retail shops in close proximity to the products these sheets promote. Methods for attaching these displays are well known.

U.S. Pat. No. 4,016,977 shows a pad of sheets attached to a holder by a central rivet permitting pivoting of the pad relative to the holder. The holder is provided with ears which, together with the upper edge of holder, are adapted to fit in the price channel which runs along the edge of display shelves. The display holder can also be affixed to a flat surface by means of an adhesive secured to the lower portion of the holder.

U.S. Pat. No. 4,477,048 shows a holder also constructed to attach a pad of sheets to the price channel running along the edge of display counters. This patent teaches the use of a centered tab adapted to be flexed for engaging the bottom edge of the channel, the top of the holder engaging the top edge of the channel. The pad is secured by an adhesive to a bottom portion of the holder.

U.S Pat. No. 4,572,380 shows various holder designs all characterized a single central prong which extends through a hole cut in the pad of sheets to facilitate their removal and affixation. This device also is shaped such that it may be attached to a price channel, peg board, hook or rod through various ears, tabs and adhesive.

Display holders which extend into store aisles to attract a customer's attention are also common. For example, U.S. Pat. Nos. 2,720,044 and 3,711,977 show a device for displaying information beyond the plane of the display shelves.

Such devices have failed to provide a single holder capable of effectively holding both a pad of promotional sheets and a display card extending perpendicularly to a display shelf.

SUMMARY OF THE INVENTION

Generally speaking, in accordance with the invention, a display holder is provided which includes a holder adapted for mounting on a support and which is capable of supporting a display card extending in a direction substantially perpendicular to the support as well as a pad of sheets.

The display card may consist of a unitary sheet having a first portion adapted to be supported by the holder along a region extending laterally therealong, a second portion joined to said first portion by at least one fold line and adapted to be positioned so as to extend in a direction substantially perpendicular to the first portion and coupling means for holding said second portion in the perpendicular position relative to the first portion. The coupling means may consist of an overlapping portion intermediate the first and second portions and joined thereto by a pair of spaced essentially parallel fold lines, a tab cut substantially from said overlapping portion so as to face towards said first portion and a slit opening formed in said first portion spaced from said overlapping portion for receipt of said tab when said overlapping portion is folded to overlay the first portion with said second portion extending perpendicularly therefrom.

In an alternative embodiment of the display card, the second portion may consist of first and second regions joined by a fold line so that the first region is coupled to the first portion by a fold line and extends in a direction essentially perpendicular to the first portion. The second region may be folded to project toward the first region. The connecting means may include a tab projecting from the end of the second region for receipt in a slot formed in the first portion The slot may be spaced from the fold line joining the first and second portions so that the first and second regions define an essentially V-shaped projection extending in a direction perpendicular to the first portion.

The holder may include an upper mounting portion for coupling to a support and a pair of downwardly projecting laterally spaced prongs for supporting at least a pad of sheets. The holder may also include a downwardly extending card support portion for coupling to the display card. The holder may be formed of a flexible sheet, the upper mounting portion including an upper edge and a lower edge spaced for receipt and retention in a price channel by flexing the upper mounting portion. The holder may be provided with a pair of legs depending from the upper mounting portion and supporting, at the ends thereof, the card support portion. The prongs depend from the card support portion on opposed sides of the legs. The lower edge of the mounting portion is defined in the region between the legs by a spaced pair of cut-out regions. The mounting portion may be formed with a pair of wings shaped for mounting on rods or insertion in apertures and/or an aperture for mounting on a projecting rod.

Accordingly, it is an object of this invention to provide a simple holder for displays and sheets.

A further object of the invention is to provide a holder which is formed from a single sheet of material which integrally incorporates the means for holding a pad of sheets and a display card extending essentially perpendicular to the support.

A further object of this invention is to provide a unitary display card adapted for support along a length thereof on a support and including a portion extending in a direction perpendicular to the support for attracting the eye of consumers.

Still another object of this invention is to provide an eye-catching display device which is easily mounted and which includes a pad of sheets plus a perpendicular display card.

Still other objects and advantages of the invention will in part be obvious and will in part be apparent from the specification.

The invention accordingly comprises the features of construction, combinations of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIGS. 3 and 4 are fragmentary sectional views taken along lines 3—3 and 4—4, respectively, of FIG. 2;

FIGS. 6, 7 and 8 are fragmentary sectional views taken along lines 6—6, 7—7 and 8—8 of FIG. 5;

DETAILED DESCRIPTION OF THE PREFERRED EMBODIMENTS

Figure 1:
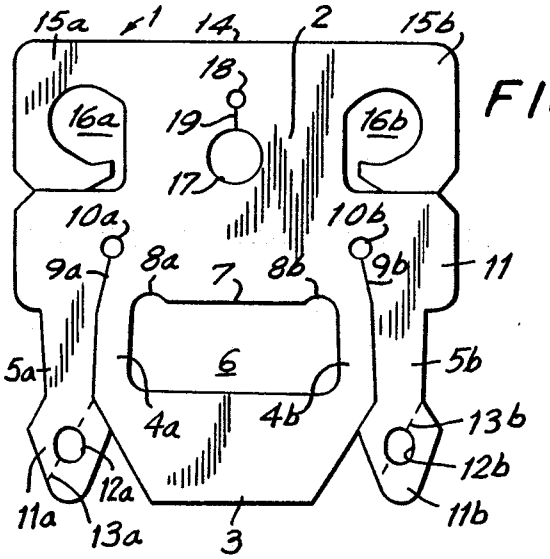
FIG. 1 is a top plan view of a holder for a sheet dispenser and display in accordance with the invention.

Referring now to FIG. 1, a holder 1 for supporting a pad of sheets and a display card is depicted. Holder 1 can be made from a substantially flat, thin sheet of flexible material. A variety of plastics are suitable for this purpose, the holder being preferably formed by being stamped or cut from a sheet of a transparent thin plastic material. The holder 1 is designed to be installed in the double flanged U-shaped price channel 103, illustrated in FIG. 2, which runs along the edge of a display shelf 104 in many stores. However, the holder may also be installed on other forms of supports as more particularly described below.

Such price channels have an upper flange 102*a* defining an upper edge of the channel and a lower flange 102*b* defining a lower edge of the channel, the holder 1 being captured between said edges as more particularly described below.

Holder 1 includes an upper mounting portion 2 and a card support portion 3 coupled to mounting portion 2 by a pair of spaced legs 4*a*, 4*b* which depend from mounting portion 2. A prong 5*a*, 5*b* depends, on either side of legs 4*a*, 4*b*, from mounting portion 2. An essentially rectangular opening 6 in holder 1 serves to define the lower edge 7 of mounting portion 2, as well as the inner edge of legs 4*a*, 4*b* and the top of card support portion 3. Additional hemispheric cut-out regions 8*a*, 8*b* in the top corners of opening 6 define the ends of lower edge 7 and permit the receipt of that lower edge in the lower flange 102*b* of a price channel 103 while permitting legs 4*a*, 4*b* and prongs 5*a*, 5*b* to extend over the lower flange 102*b* as more particularly described below. Cut lines 9*a* and 9*b* extending from apertures 10*a*, 10*b* serve to define the prongs 5*a*, 5*b* as well as the respective outer edges of legs 4*a*,4*b*. Each prong 5*a*, 5*b*, which is flexible, is formed with a central thinner region and an enlarged arrow-head shaped head 11*a*, 11*b*. The head 11*a*, 11*b* of each prong 5*a*, 5*b* is formed with an aperture 12*a*, 12*b* and a diagonal score line 13*a*, 13*b* intersecting apertures 12*a*, 12*b* and adapted to permit folding of the head of the prongs to permit insertion in a pad, as more particularly described below.

Mounting portion 2 is formed with an essentially straight upper edge 14 for receipt in the upper flange 102*a* of a price channel 103. The upper left and right hand corners of mounting portion 2 are formed with respective hook-shaped wings 15*a*, 15*b*. Hook-shaped wings 15*a*, 15*b* extend around enlarged openings 16*a*, 16*b* dimensioned to receive typical rack bars as more particularly described below. Mounting portion 2 is also formed with an enlarged central aperture 17 joined to a smaller aperture 18 above aperture 17 by a cut line 19.

Figure 2:
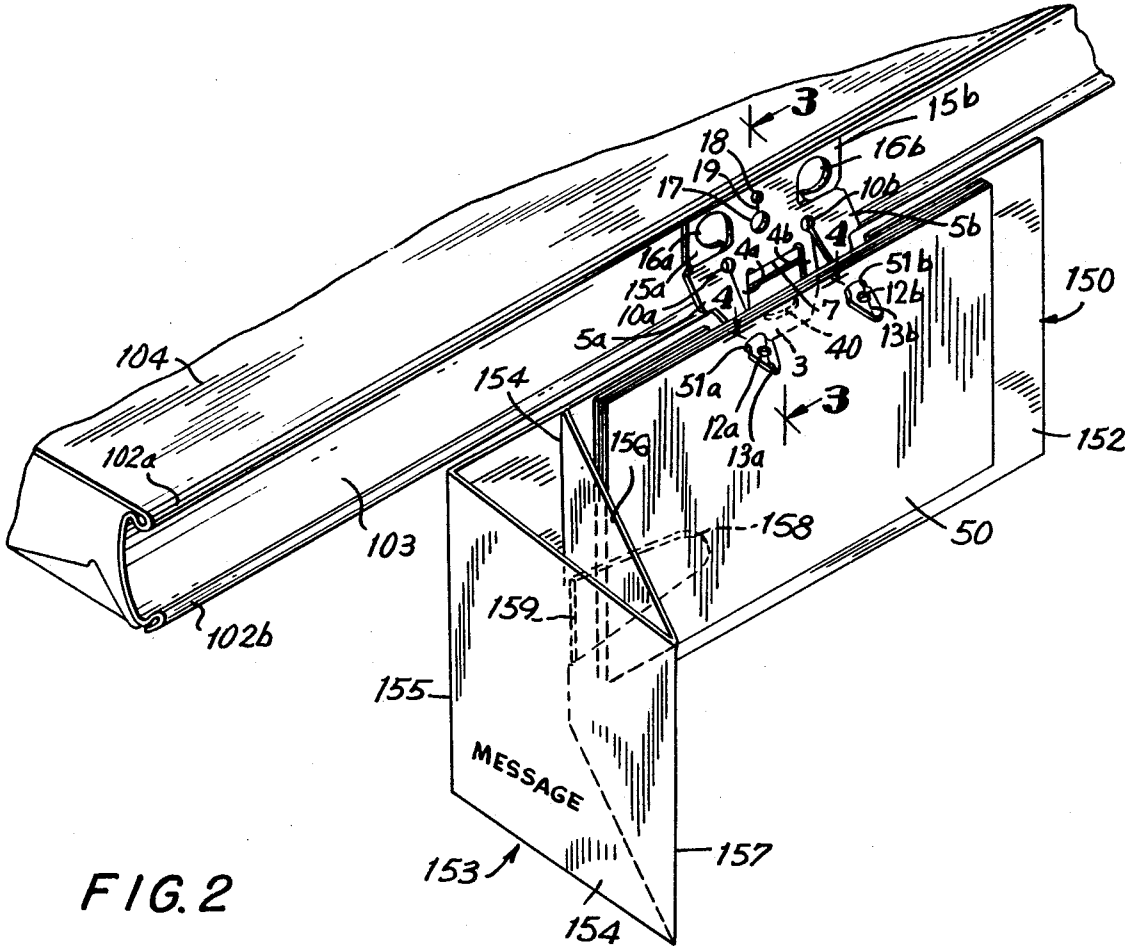
FIG. 2 is a perspective view of the holder of FIG. 1 supporting a pad and display card in accordance with the invention mounted in a price channel.

FIGS. 2 and 3 illustrate how the holder 1 is installed in price channel 103. Specifically, upper edge 14 of mounting portion 2 is inserted into upper flange 102*a* of channel 103 and lower edge 7 is inserted into lower flange 102*b*. The distance from edge 14 to edge 7 is slightly greater than the distance from the upper end of the channel defined by flange 102*a* and the lower end of the channel defined by 102*b*. When edges 7 and 14 are initially inserted in the respective flanges, mounting portion 2 bows outwardly but when pressure is applied centrally to the mounting portion, the flexible mounting portion snaps inwardly into the channel to assume the position depicted in FIG. 3 with legs 4*a*, 4*b* and prongs 5*a* and 5*b* extending over and past lower flange 102*b*.

Figure 11:
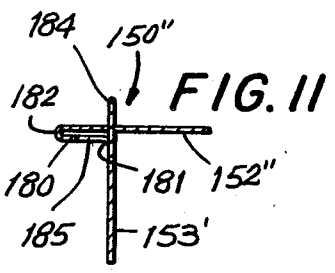
FIG. 11 is a cross-sectional view taken along lines 11—11 of FIG. 9.

Aperture 17 is dimensioned to receive a hook such as the types of hooks mounted on peg boards as illustrated in FIG. 11 of U.S. Pat. No. 4,572,380, incorporated herein by reference. Aperture 17 can also accommodate the head of a nail, in which case the thinner shank of the nail may be received within aperture 18. Once the holder is passed over the head of the nail, the nail shank is passed through the opening defined by cut line 19 to the smaller aperture 18.

Figure 9:
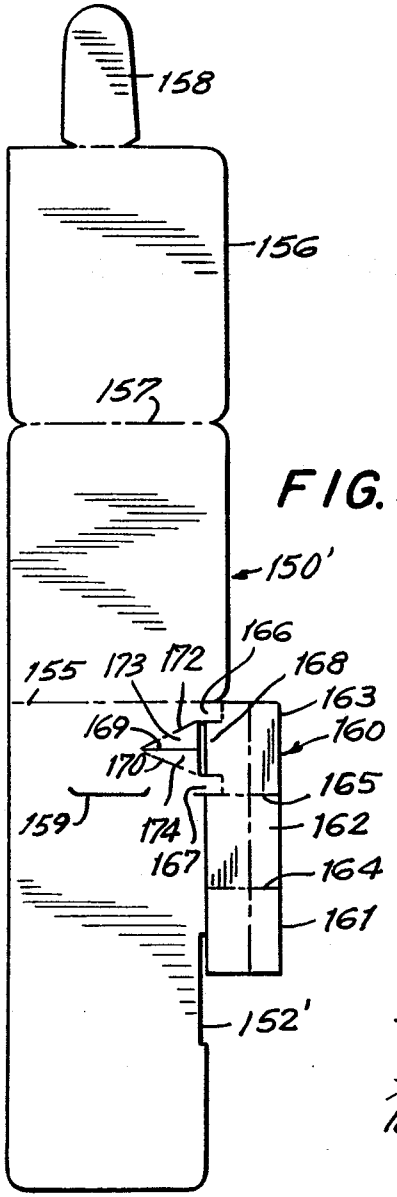
FIG. 9 is a top plan view of the display card of FIG. 5 before folding for use.

Wings 15*a* and 15*b* are adapted to be folded back for engagement on a lateral rod forming part of a basket or rod structure commonly used in supermarkets, as illustrated in FIGS. 8 and 9 of U.S. Pat. No. 4,572,380, incorporated within by reference. Wings 15*a* and 15*b* are also adapted to be forced into apertures on a support as illustrated in FIGS. 6 and 7 of U.S. Pat. No. 4,562,380, also incorporated herein by reference. Finally, if desired, an adhesive can be applied to all or a substantial part of mounting portion 2 for securing to a suitable support. In such a case, the adhesive would generally be initially protected by contact paper which can be peeled off before mounting. The adhesive would preferably be provided in the region between wings 15*a*, 15*b* and may be provided on said wings.

A pad 50 having a pair of spaced apertures 51*a* and 51*b* may be mounted on prongs 5*a*, 5*b*. As noted above, the heads 11*a*, 11*b* are folded along score lines 13*a*, 13*b* and respectively inserted in apertures 51*a*, 51*b* of pad 50. Pad 50 is formed of a plurality of sheets as more particularly seen in FIGS. 3 and 4. While the heads of prongs 5*a*, 5*b* serve to hold the sheets of the pad in position for display, single sheets can be readily torn from the pad as desired by consumers.

Holes 12*a* and 12*b* are provided in heads 11*a*, 11*b* to facilitate mounting of the pad. A string, wire, hook or other tool can be used to pull the heads through the holes in the pad. The smaller the holes in pad 50, the more stable the pad will rest on the prongs. Therefore, it is useful to have foldable prong heads with holes to insure a tight fit. The use of two prongs provides greater stability for the pad and aids in holding the pad parallel to the shelf.

Figure 5:
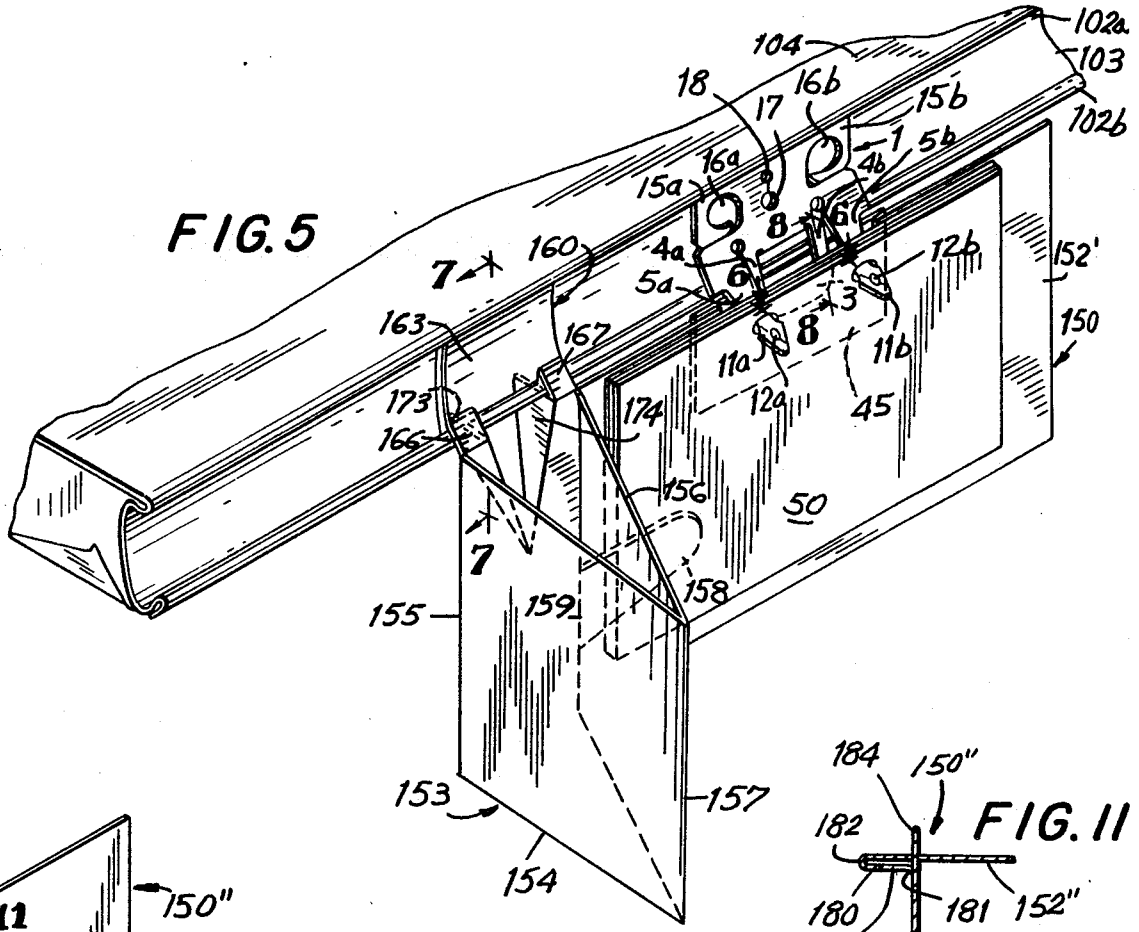
FIG. 5 is a perspective view of the holder of FIG. 1 supporting in a price channel an alternative construction of the display card in accordance with the invention and a pad.

An additional display element in the form of a display card 150 can be added. The display card 150 can be attached to the card support portion 3 in a number of ways. FIG. 4 shows the use of staple 40 to attach display card 150 to card support portion 3. Alternatively, as shown in FIGS. 5 and 6, an adhesive strip 45 can be used to attach display card 150 to card support portion 3. An adhesive could also be used. These methods, alone or in combination, or any other attachment method which yields a stable attachment of the display card to card support portion 3 can be used. In order to provide stable mounting, the mounting region of the display card should extend laterally thereof over the surface of display card 150.

A feature of the display card in accordance with the invention is that it can be shaped to extend into the store aisles, away from the plane of the display shelves. Referring to FIGS. 2-4, display card 150 includes a first portion 152 which is secured to card support portion 3 and hangs downwardly substantially parallel to shelf 104 from card support portion 3 of holder 1. When so mounted, first portion 152 is supported behind the pad 50. A second portion 153 of display card 150 projects essentially perpendicular to the price channel and first portion 152. Second portion 153 consists of a first region 154 joined by fold line 155 to first portion 152 and extending away therefrom, and a second region 156 joined to first region 154 by fold line 157 and extending back in the direction of first portion 152. Second region 156 is formed with a tab or finger 158 projecting centrally from the end thereof. First portion 152 is formed with a vertically extending slit 159 therethrough positioned spaced from fold line 155 so that when tab 158 is passed through slit 159, and folded back to extend substantially parallel to first portion 152, a V-shaped second portion 153 projecting substantially in a direction perpendicular to price channel 103 and first portion 152 is provided. The outer surfaces facing the aisle, of first portion 152 and second portion 153, would bear suitable advertising or promotional messages as desired.

If additional stability for the display card is desired, an alternate embodiment as shown in FIGS. 5-9 may be adopted, like reference numerals being applied to like elements. In the embodiment of FIGS. 5-9, the first portion 152' of display card 150' is provided with a mounting tab 160 formed integrally therewith. Mounting tab 160 is divided into three sections 161, 162 and 163 respectively separated by fold lines 164 and 165. The boundary between first portion 152' and sections 161 and 162 is cut during formation so that sections 161 and 162 can be folded upon each other and so as to overlap section 163 to form a relatively strong member for insertion in the price channel. Section 163 is joined to first portion 152' by a pair of tabs 166 and 167 which, because of their dimensions, are flexible. The central edge of section 163 facing first section 152' is cut to define a tab 168. Cut line 169 and fold lines 170 and 172 in the region of first portion 152' facing tab 168 define two V-shaped tabs which may be folded outwardly as more particularly shown in FIGS. 5 and 7. In use, sections 161 and 162 are folded on each other and so as to overlap section 163 and the V-shaped sections 173 and 174 defined by cut line 169 and fold lines 170 and 172, are folded outwardly. The top edge of the folded sections 161, 162 and 163 is inserted in the upper flange **102*a* while tab 168 and the lower edge of sections 161 and 162 are inserted in the lower flange 102*b*. The tabs 166 and 167 extend over the channel to support the balance of the display card. Further support is provided by the V-shaped tabs 173, 174 which engage the underside of price channel 103**.

Figure 10:
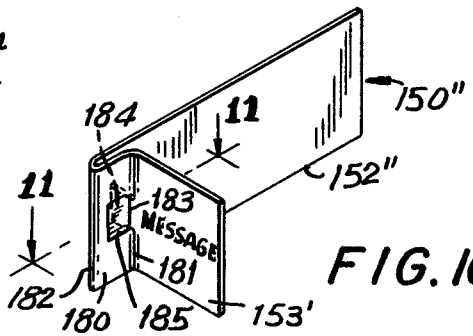
FIG. 10 is a perspective view of a third embodiment of the display card in accordance with the invention.

Referring now to FIGS. 10 and 11, a third embodiment of a display card 150'' is depicted. Display card 150'' includes a first portion 152'', a second portion 153' and a short overlapping portion 180 joined to second portion 153' by fold line 181 and to first portion 152'' by fold line 182. First portion 152'' is formed with a vertical slit 183 positioned for registration with fold line 181 when overlapping portion 180 is folded to overly first portion 152''. A tab 184 is formed by cut line 185 in overlapping portion 180. Tab 184 is received in slit 183 to hold overlapping portion 180 in position overlying second portion 153'. Second portion 153' is folded along fold line 181, so as to extend in a direction extending substantially perpendicular to first portion 152'' and price channel 103. Slits may be provided at the junction of tab 184 and second portion 153' to provide an interlock with slit 184 to hold the assembly in the desired folded position.

The sheet dispenser and display and holder therefor in accordance with the invention provide a simple means for dispensing point-of-sale coupons or advertising and promotional material. The device joins the features of sheet dispensing, ease of mounting on various means of support and the eye-catching advantage of a display card projecting into the aisle.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A display holder for releasably supporting a pad of sheets in a price channel support having spaced inwardly facing upper and lower flanges, the pad being formed with a pair of spaced apertures therethrough, comprising:

a mounting portion adapted for coupling to the support, the mounting portion being formed with an upper first edge and a lower second projecting edge, the first and second edges of the mounting portion being spaced a distance slightly greater than the spacing between the edges of the channel of the price channel defined by the flanges for receipt therein and positioned in the channel by the flexing the mounting portion toward the channel; and a pair of laterally spaced prongs formed with enlarged heads and shaped to permit insertion of the prongs through the apertures of said pad for retention of said pad while permitting removal of sheets therefrom, the prongs being flexibly integrally connected to the mounting portion at positions intermediate the upper and lower edges of the mounting portion and depending outside both sides of the lower second edge, said mounting portion and prongs of the holder being integral and formed from flexible sheet material.

2. The holder of claim 1, wherein the display holder can also support a display card, and including a card support portion flexibly and integrally connected to and depending from outside both sides of the lower edge of the mounting portion by a pair of legs, the card support portion intermediate said prongs and adapted for coupling to a display card positioned behind the pad.

3. The holder of claim 2, wherein the card support portion is coupled to the mounting portion by a pair of laterally spaced legs positioned intermediate the prongs, the mounting portion being formed with a first edge on the side away from the prongs and a second projecting edge positioned intermediate the legs, the first and second edges of the mounting portion is spaced a distance slightly greater than the spacing between the edges of the channel of the price channel defined by the flanges for receipt therein and the holder is positioned in the channel by flexing the mounting portion toward the channel.

4. The holder of claim 3, and including a pair of cut-out regions one adjacent each of said legs to define the projecting lower second edge.

5. The holder of claim 3, wherein the support includes one of a rod and a pair of spaced apertures, wherein the mounting portion is formed with a pair of wings on opposed sides thereof adjacent said upper first edge shaped for mounting on a rod or insertion in spaced apertures.

6. The holder of claim 3, wherein the support includes a projecting rod, wherein said mounting portion is formed with at least one aperture therethrough for mounting on a projecting rod.

7. The holder of claim 1, wherein said sheet material is a plastic.

8. The holder of claim 1, wherein the heads of said prongs are essentially arrow-shaped and formed with an aperture therethrough and a fold line for facilitating insertion in the apertures of the pad.

9. A sheet dispenser and display for mounting on a support, the support being a price channel having spaced inwardly facing flanges, comprising:

a pad of sheets formed with a pair of spaced apertures therethrough;

a display card; and a holder formed of a sheet of flexible material including a mounting portion adapted for coupling to the support, a pair of laterally spaced flexible prongs formed with enlarged heads and shaped to permit insertion of the prongs through the apertures of said pad for retention of said pad while permitting removal of sheets therefrom and the holder also including a card support portion projecting from the mounting portion intermediate said prongs and adapted for coupling to the display card positioned behind the pad, the card support portion coupled to the mounting portion by a pair of laterally spaced legs positioned intermediate the prongs, the mounting portion formed with a first edge on the side away from the prongs and a second projecting edge positioned intermediate the legs, the first and second edges of the mounting portion being spaced a distance slightly greater than the spacing between the edges of the channel of the price channel defined by the flanges for receipt therein and positioned by the flexing of the mounting portion toward the channel.

10. The sheet dispenser and display of claim 9, wherein said sheet material is a plastic.

11. The sheet dispenser and display of claim 9, and including a pair of cut-out regions one adjacent each of said legs to define the projecting second edge.

12. The sheet dispenser and display of claim 9, wherein the support includes a rod or a pair of opposed apertures, wherein the mounting portion is formed with a pair of wings on opposed side thereof adjacent said first edge shaped for mounting on a rod or insertion in spaced apertures.

13. The sheet dispenser and display of claim 9, wherein the support includes a projecting rod, wherein said mounting portion is formed with at least one aperture therethrough for mounting on a projecting rod.

14. The sheet dispenser and display of claim 9, wherein the heads of said prongs are essentially arrow-shaped and formed with an aperture therethrough and a fold line for facilitating insertion in the apertures of the pad.

15. A sheet dispenser an display for mounting on a support, comprising:

a pad of sheets formed with a pair of spaced apertures therethrough;

a display card formed of a unitary sheet having a first portion adapted to be supported by the holder, a second portion joined to said first portion by at least one fold line and adapted to be positioned so as to extend in a direction substantially perpendicular to the first portion and coupling means for holding said second portion in the essentially perpendicular position relative to the first portion; and a holder including a mounting portion adapted for coupling to the support and a pair of laterally spaced flexible prongs formed with enlarged heads and shaped to permit insertion of the prongs through the apertures of said pad for retention of said pad while permitting removal of sheets therefrom and a card support portion projecting from the mounting portion intermediate said prongs and adapted for coupling to the display card positioned behind the pad.

16. The sheet dispenser and display of claim 15, wherein the coupling means consists of an overlapping portion intermediate the first and second portions and joined thereto by a pair of spaced essentially parallel fold lines, a tab cut substantially from said overlapping portion so as to face towards said first portions and a slit opening formed in said first portion spaced from said overlapping portion for receipt of said tab when said overlapping portion is folded to overlay the first portion with said second portion extending perpendicularly therefrom.

17. The sheet dispenser and display of claim 15, wherein said second portion consists of first and second regions joined by a fold line so that the first region is coupled to the first portion by said first-mentioned fold and extends in a direction essentially perpendicular to the first portion and the second region may be folded to project towards the first region, said connecting means including a tab projecting from the end of the second region and a slot formed in the first portion for receipt of said tab.

18. The sheet dispenser and display of claim 17, wherein said slot is spaced from said first-mentioned fold line joining the first and second portions so that the first and second regions of said second portion define an essentially V-shaped projection extending substantially in a direction perpendicular to the first portion.

19. The sheet dispenser and display as recited in claim 15, wherein the support is a price channel having spaced inwardly facing flanges, and wherein said display card is formed with an integral stabilizing member projecting from the upper edge of said first portion and shaped, either before or after manipulation, for receipt in said price channel for stabilizing the position of the display card.

20. The sheet dispenser and display as recited in claim 19, and wherein said stabilizing member is adapted to be folded to provide increased strength in the portion inserted in the price channel.

21. The sheet dispenser and display as recited in claim 19, wherein said stabilizing member is joined to said first portion by a pair of spaced tabs, the region of said stabilizing member intermediate said tabs defining a projection toward the first portion for receipt in the lower flange of the price channel.

22. The sheet dispenser and display as recited in claim 21, wherein the edge of said second portion facing said stabilizing member is formed with a slit extending therefrom inwardly to define a pair of triangular tabs having upper edges which, when folded to project away from the plane of said first portion and the upper edges can engage a bottom surface of the lower flange to, cooperate with the stabilizing member to stabilize the display card.

* * * * *